US005527132A

United States Patent [19]

Labbe

[11] Patent Number: 5,527,132

[45] Date of Patent: Jun. 18, 1996

[54] ANTI-SURGE METHOD AND APPARATUS FOR OFFSHORE STRUCTURES

[75] Inventor: Jean-Paul Labbe, 92300 Levallois Perret, France

[73] Assignee: ETPM, Societe Anonyme, Nanterre, France

[21] Appl. No.: 417,375

[22] Filed: Apr. 5, 1995

[30] Foreign Application Priority Data

Apr. 12, 1994 [FR] France ..... 94 04312

[51] Int. Cl.[6] ..... B63B 21/00

[52] U.S. Cl. ..... 405/195.1; 114/230

[58] Field of Search ..... 405/195.1, 204, 405/211, 212; 114/230, 231

[56] References Cited

U.S. PATENT DOCUMENTS

| | | | |
|---|---|---|---|
| 1,094,610 | 4/1914 | Steinhauer | 114/230 |
| 4,003,329 | 1/1977 | Robinson | 114/242 |
| 4,008,678 | 2/1977 | Lawlor | 114/230 |
| 4,066,030 | 1/1978 | Milone | 114/230 |
| 5,150,744 | 9/1992 | Hayashi et al. | 114/230 |
| 5,201,274 | 4/1993 | Rinkewich | 114/230 |

OTHER PUBLICATIONS

G. J. White et al., "Offshore Installation of an Integrated Deck Onto a Preinstalled Jacket", OTC 5 260, 18th Annual Offshore Technology Conference in Houston, Tex., May 5–8, 1986.

*Primary Examiner*—Hoang C. Dang
*Attorney, Agent, or Firm*—Gottlieb, Rackman & Reisman

[57] ABSTRACT

The method enables alternating surge motion between two offshore structures placed side by side and at least one of which is floating to be reduced to a small value. Bumpers are installed on one of the offshore structures and are capable of being placed to face thrust surfaces of the other offshore structure, and they are movable in a direction parallel to the direction of the surge motion. The bumpers are brought into contact with the thrust surfaces of the offshore structure and they are held pressed resiliently against the thrust surfaces with a predefined thrust force while allowing each of the bumpers to move with alternating motion relative to the second offshore structure in both directions of the surge motion. The bumpers are brought to rest relative to the second offshore structure at a moment when the speed of the surge motion is zero.

16 Claims, 8 Drawing Sheets

ANTI-SURGE METHOD AND APPARATUS FOR OFFSHORE STRUCTURES

FIELD OF THE INVENTION

The present invention relates to a method and to apparatus for preventing or at least reducing to a small value any alternating surge motion between two offshore structures which have been placed one beside the other and at least one of which is floating, a first of the two offshore structures having first and second vertical thrust surfaces facing in opposite directions along a horizontal direction in which the surge motion that is to be reduced is taking place.

BACKGROUND OF THE INVENTION

As is well known, a ship or other freely floating structure at sea, without propulsion, and subject to the action of swell, performs motion that is complex, and that can be resolved into six motions: three rotary motions; and three linear motions. In a system of orthogonal axes X, Y, and Z, these six motions comprise: roll which is alternating rotation about the X axis; pitching which is alternating rotation about the Y axis; yaw which is alternating rotation about the Z axis; surge which is alternating translation along the X axis; sway which is alternating translation along the Y axis; and heave which is alternating translation along the Z axis.

When two offshore structures are placed side by side, while one of the structures is floating and the other is either fixed or floating, it is sometimes necessary to limit the motions of the two offshore structures relative to each other. This applies, for example, when it is necessary to stabilize a barge carrying a deck which is to be placed on a support structure and fixed thereto. In the context of the present description, the term "deck" is used for any type of platform superstructure installed at sea. The deck conventionally comprises a plurality of vertical tubular legs made of steel or of concrete or partly of steel and partly of concrete, and which are placed on and fixed to a support structure. The term "support structure" is used to designate any type of infrastructure, commonly referred to as a "jacket" in this technical field and designed to support the deck of the offshore platform. In service, the support structure may be completely or partially immersed, and it may optionally stand on a sea bed. Conventionally, the support structure has the same number of legs as the deck. The legs of the support structure are generally vertical or substantially vertical or else they are vertical in part and inclined in part relative to the vertical. In addition, in the context of the present invention, the term "barge" is used to designate any ballastable floating vehicle capable of transporting the deck of an offshore platform.

The deck and the support structure of an offshore platform are conventionally prefabricated separately on land or in a dry dock or in a graving dock, and they are subsequently taken and/or towed separately to a site at sea where they are then assembled together. The assembly site may be the site at which the platform is to be used, or it may be some other site selected for its sufficient depth of water and for sea conditions that are relatively calm. To place the deck on the support structure, the barge carrying the deck is brought between the legs of the support structure. In order to ensure that the deck-placing operation takes place under good conditions when the sea is subject to swell, it may be necessary to restrict the motion of the barge relative to the support structure. The load-bearing surfaces of the deck legs and the load-bearing surfaces of the receiving portions at the top ends of the support structure legs are of limited size, and their sizes may sometimes be smaller than the amplitude of the horizontal motion of the barge. Conventionally, yaw, roll, and sway motions of the barge are limited by guides, optionally including shock absorbers, disposed between the barge and the legs of the support structure. In addition, various known systems have already been proposed to limit surge movements of the barge relative to the support structure. A first known system consists in using anchor lines and/or hawsers connecting the barge to the support structure. However, experience shows that such a known system is inadequate for limiting surge motion. A second known system consists in using guiding pins, i.e. pegs mounted vertically that are movable along the legs of the deck and that are capable of being engaged in cylindrical sockets that are rigidly fixed to the outsides of the legs of the support structure. Here again, experience shows that such a system is fragile, and above all that it is unsuitable for stopping a barge which is subjected to surge motion. A third known system is described, for example, in the article entitled "Offshore installation of an integrated deck onto a preinstalled jacket" by G. J. White et al., OTC 5260, Offshore Technology Conference, 18th Annual Conference at Houston, Tex. May 5–8, 1986, page 322, righthand column and FIG. 4. In the third known system, each leg of the deck (or at least some of them) contains a kind of plunging piston capable of being engaged in a centering tube with an inlet cone provided at the top ends of the corresponding legs of the support structure. A radial shock absorber constituted by a sleeve of elastomer material and referred to as "radial elastomer" is disposed in the annular space between the centering tube and the leg-forming tube of the support structure. The difference between the second and third above-described known systems lies essentially in the presence of the radial elastomer which provides an improvement with respect to fragility, but which constitutes a drawback with respect to preventing motion, specifically because the radial elastomer is compressible. In addition, when the surge motion is large, that third known system becomes too fragile.

OBJECTS AND SUMMARY OF THE INVENTION

In general terms, an object of the present invention is thus to provide a method and apparatus of the type defined above that makes it possible to prevent or at least reduce to a small value any surge motion of a floating offshore structure that is subject to the action of swell and relative to another offshore structure which may be fixed or likewise floating.

A subsidiary object of the present invention is to provide a method and apparatus making it possible, after the surge motion has been stopped and one of the two offshore structures is held stationary in a position that is close to its desired position relative to the other offshore structure, to adjust the position of one of said two offshore structures finely relative to the other.

More particularly, the present invention seeks to provide a method and apparatus making it possible to prevent, or at least to reduce to a small value, any surge motion between a barge carrying a deck, and a floating or fixed support structure onto which the deck is to be placed, and to achieve this without exerting any significant influence on the other five motions of the barge and without producing very high connection forces between the barge and the support structure.

To this end, the method of the present invention consists:

a) in installing on the second offshore structure at least first and second bumpers capable of being displaced from respective retracted positions to respective extended positions in which the first and second bumpers face the first and second thrust surfaces respectively of the first offshore structure and are horizontally spaced apart from said first and second thrust surfaces, each of said bumpers also being mounted on the second offshore structure in such a manner as to be movable in a direction parallel to the direction of surge motion and with a maximum acceptable stroke of predefined value;

b) in bringing one of the two offshore structures into a position such that its mean position between two extreme positions due to the alternating surge motion corresponds approximately to the desired position for said offshore structure relative to the other offshore structure;

c) in measuring the total amplitude of the alternating surge motion between the two extreme positions;

d) in placing the first and second bumpers into their respective extended positions if the total measured amplitude is smaller than the maximum acceptable stroke of the bumpers;

e) in bringing the first and second bumpers into contact with the first and second thrust surfaces respectively of the first offshore structure and in holding them pressed resiliently against said thrust surfaces with a predefined thrust force, while nevertheless allowing alternating relative motion to take place between each of the two bumpers and the second offshore structure in both directions of the surge motion; and f) in bringing the bumpers to rest relative to the second offshore structure at a moment when the speed of surge motion is zero.

The apparatus of the invention comprises at least first and second bumpers which are mounted on the second offshore structure in such a manner as to be movable between respective retracted positions and respective extended positions in which they face the first and second thrust surfaces respectively of the first offshore structure and are horizontally spaced apart from said first and second thrust surfaces, and in such a manner as also to be horizontally movable in a direction parallel to the direction of surge motion, first and second actuator means connected to the first and second bumpers respectively to bring them into their extended positions, third and fourth actuator means connected to the first and second bumpers respectively to bring them into contact with the first and second thrust surfaces respectively of the first offshore structure, first and second pressure means associated with the first and second bumpers respectively to keep them resiliently pressed against said thrust surfaces while nevertheless allowing alternating relative motion between each of the two bumpers and the second offshore structure in both directions of the surge motion, and first and second controlled locking means associated with the first and second bumpers respectively to hold them stationary relative to the second offshore structure when so desired.

In a preferred embodiment of the present invention, each of said first and second controlled locking means is constituted by coupling means mounted between the third or fourth actuator means and the first or second pressure means respectively, and having two states, namely: a first state authorizing said alternating relative motion between the corresponding first or second bumper and the second offshore structure in both directions of surge motion; and a second state authorizing relative movement in one direction only between the corresponding first or second bumper and the second offshore structure in the direction of the thrust force of said corresponding first or second bumper against the associated thrust surface of the first offshore structure, each of the coupling means acting as locking means when in its second state.

Each of the third and fourth actuator means may be constituted by a double acting hydraulic actuator which is mounted between the second offshore structure and the corresponding first or second bumper and has its longitudinal axis parallel to the direction of surge motion. In which case, each of the first and second pressure means may be constituted by a low pressure accumulator connected by said coupling means to one of the chambers of the hydraulic actuator which, when fed with hydraulic fluid under pressure by the low pressure accumulator, causes the corresponding bumper to be moved towards the associated thrust surface of the first offshore structure. Under such conditions, said coupling means may be constituted by at least one controlled non-return valve which, when put in a first state, establishes both-way communication at a high flow rate between the low pressure accumulator and said chamber of the hydraulic actuator, and when put in a second state, authorizes one-way communication only at a large flow rate from the low pressure accumulator towards said chamber of the hydraulic actuator.

The apparatus of the invention may further comprise at least one controlled on/off valve or controlled distributor valve having two ports and two positions, which valve is connected in series with a flow rate limiter and can be controlled to establish communication at a low flow rate between said chamber of the hydraulic actuator and a hydraulic fluid tank. As explained in detail below, such a controlled valve associated with the hydraulic actuator of each bumper makes it possible to adjust finely and gently the position of the second offshore structure relative to the first.

When the apparatus of the invention is intended for use in reducing surge motion between a barge and the support structure for an offshore platform, said first offshore structure may be the support structure of the platform and said second offshore structure may be the barge. In which case, the apparatus of the invention may comprise two first bumpers disposed in the forward region of the barge symmetrically about its longitudinal axis, and two second bumpers disposed in the aft region of the barge symmetrically about its longitudinal axis. Said thrust surfaces may comprise vertical surfaces of the legs of the support structure for the platform. Each bumper is then organized to cooperate with a respective leg of the platform support structure.

BRIEF DESCRIPTION OF THE DRAWINGS

Other characteristics and advantages of the present invention appear from the following description of a preferred embodiment of the present invention given by way of example and with reference to the accompanying drawings, in which.

MORE DETAILED DESCRIPTION

The present invention is described below in its application to stabilizing a barge relative to a support structure ("jacket") of an offshore platform, in particular for the purpose of preventing the barge from being subjected by the swell to surge motion relative to the support structure.

Figure 2:
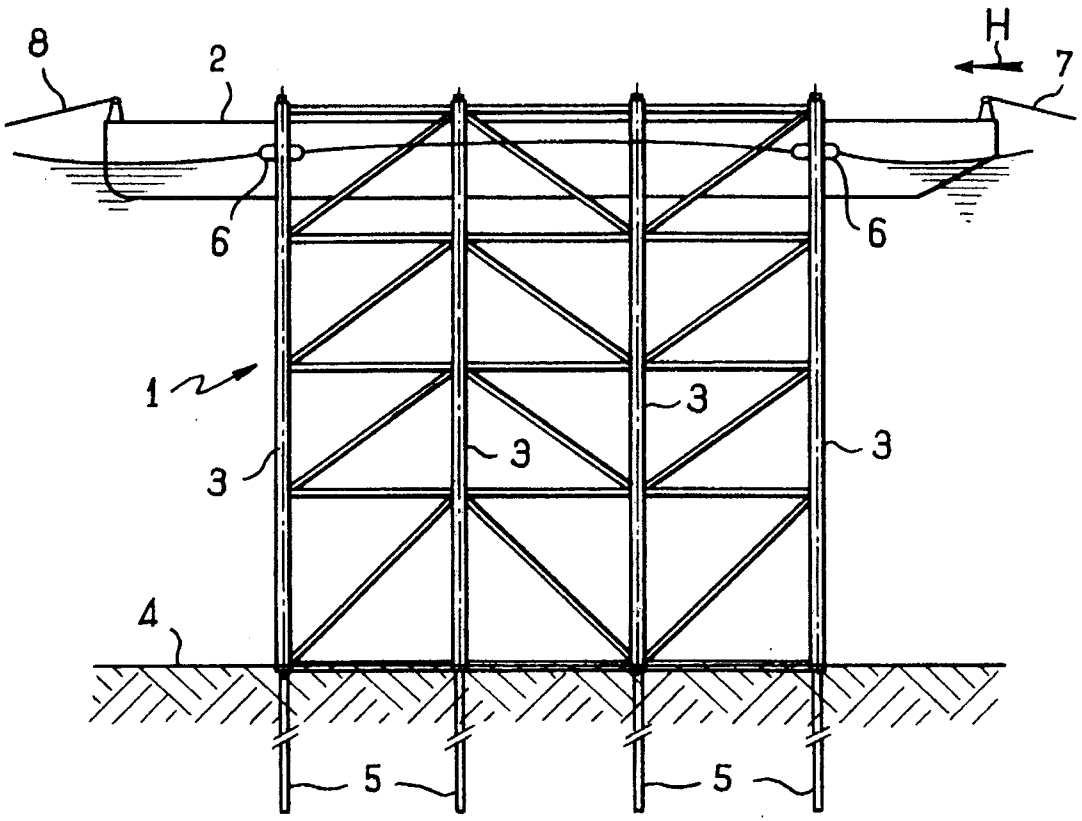
FIGS. 1 and 2 are an end elevation view and a side view showing a barge engaged between the legs of an offshore platform support structure ("jacket"), the deck of the platform not being shown.
Figure 1:
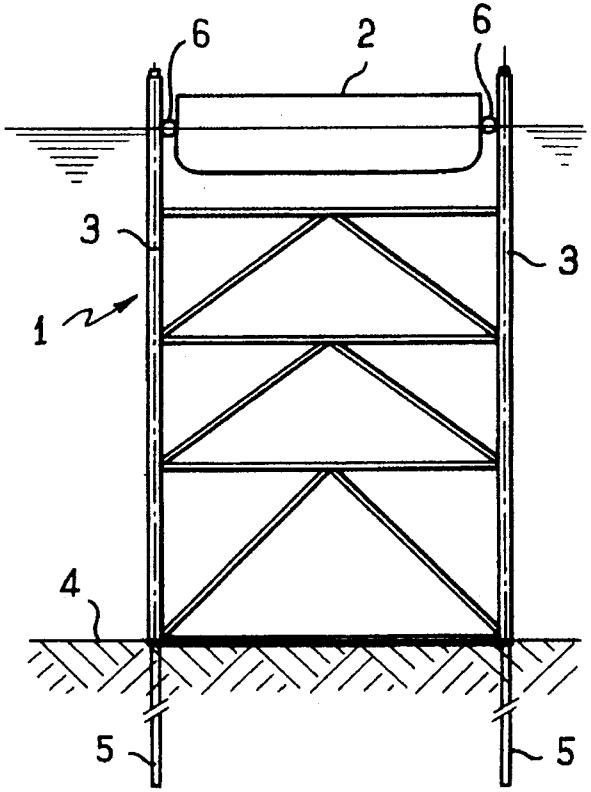
Figure 5:
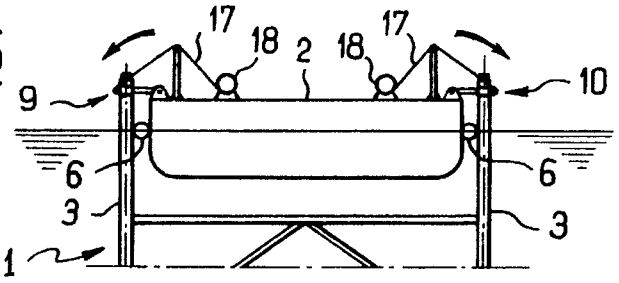
FIGS. 5 and 6 are views corresponding to FIGS. 3 and 4 and show the four bumpers in their extended positions.

In a known technique for placing the deck of an offshore platform on the support structure 1 of said platform or for removing said deck after the offshore platform has finished service on a given operating site (see for example the above-mentioned OTC 5260 publication), the barge 2 that is carrying the deck or onto which the deck is to be loaded is engaged between the legs 2 of the support structure 1, as shown in FIGS. 1 and 2. In these figures, the deck of the platform is omitted for simplification purposes and insofar as it does not form a part of the invention and is not necessary for understanding the invention. In FIGS. 1 and 2 the support structure is a fixed structure, i.e. its legs 3 are fixed to the sea bed 4 by piles 5 driven into the bed 4. Nevertheless, the invention is also applicable to a floating support structure that is held over the operating site of the offshore platform by a plurality of anchor lines and/or by a plurality of ties anchored to the sea bed 4, as is conventional in the art of offshore platforms.

When the swell has a preferred or dominant direction (indicated by arrow H in FIG. 2) that has been observed on the site where the offshore platform is to be installed, it is most advantageous for the barge 2 to face the dominant swell and consequently for the support structure 1 to be initially installed in that orientation. Under such conditions, roll, yaw, and sway motions of the barge 2 are minimized, and that is very important during an operation of installing or removing a deck of an offshore platform, but unfortunately surge motion is then at a maximum. Residual yaw and sway motions of the barge can easily be reduced to values that are acceptable for the needs of the intended operation of installing or removing the deck by using known means, e.g. such as flexible fenders 6, as shown in FIGS. 1 and 2.

In addition, the barge 2 can be temporarily held in place longitudinally by known means such as tugs, a dynamic positioning system, hawsers, or indeed fore and aft anchor lines 7 and 8, as shown in FIG. 2. However, even if the hawsers or anchor lines are highly tensioned, they still cannot reduce the surge motion of the barge to a value that is acceptable for the intended operation of installing or removing the deck. It is therefore usually necessary to provide additional means for preventing or reducing the surge motion of the barge to acceptable values. As mentioned above, known systems use guiding pins or plunger pistons with or without radial elastomer and they are fragile and/or difficult to implement in the presence of significant swell.

As explained below, the present invention provides a method and apparatus enabling the barge 2 to be held stationary regarding its surge motion relative to the support structure 1, while still leaving the barge with its other freedoms of motion, in particular relating to heave, roll, and pitching motions, with yaw and sway motions being limited by other known means such as the above-mentioned flexible fenders 6.

As shown in FIGS. 3 to 6, four bumpers 9, 10, 11, and 12 are installed on the deck of the barge 2 at the four corners thereof. The fore port bumper 9 and the aft starboard bumper 12 are identical. Likewise, the fore starboard bumper 10 and the aft port bumper 11 are identical and respectively symmetrical to the bumpers 9 and 12 about the longitudinal axis 13 of the barge 2.

Figure 6:
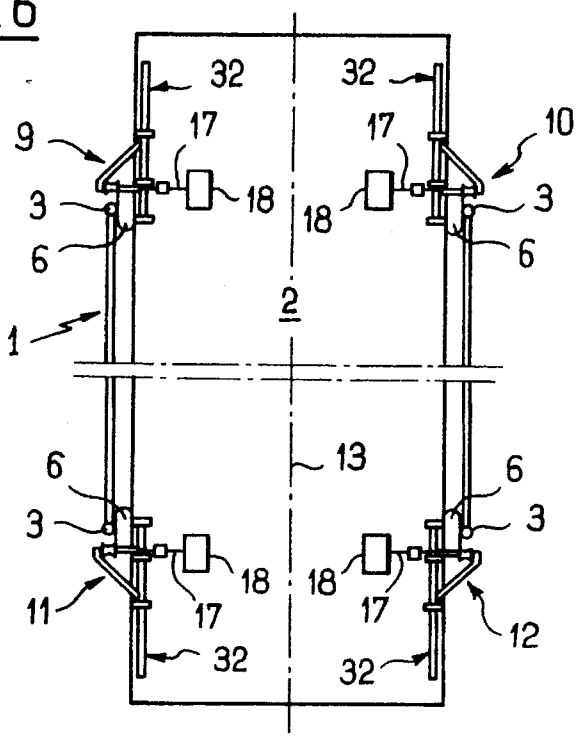
Figures 7, 8, 9, 10, 11, 12:
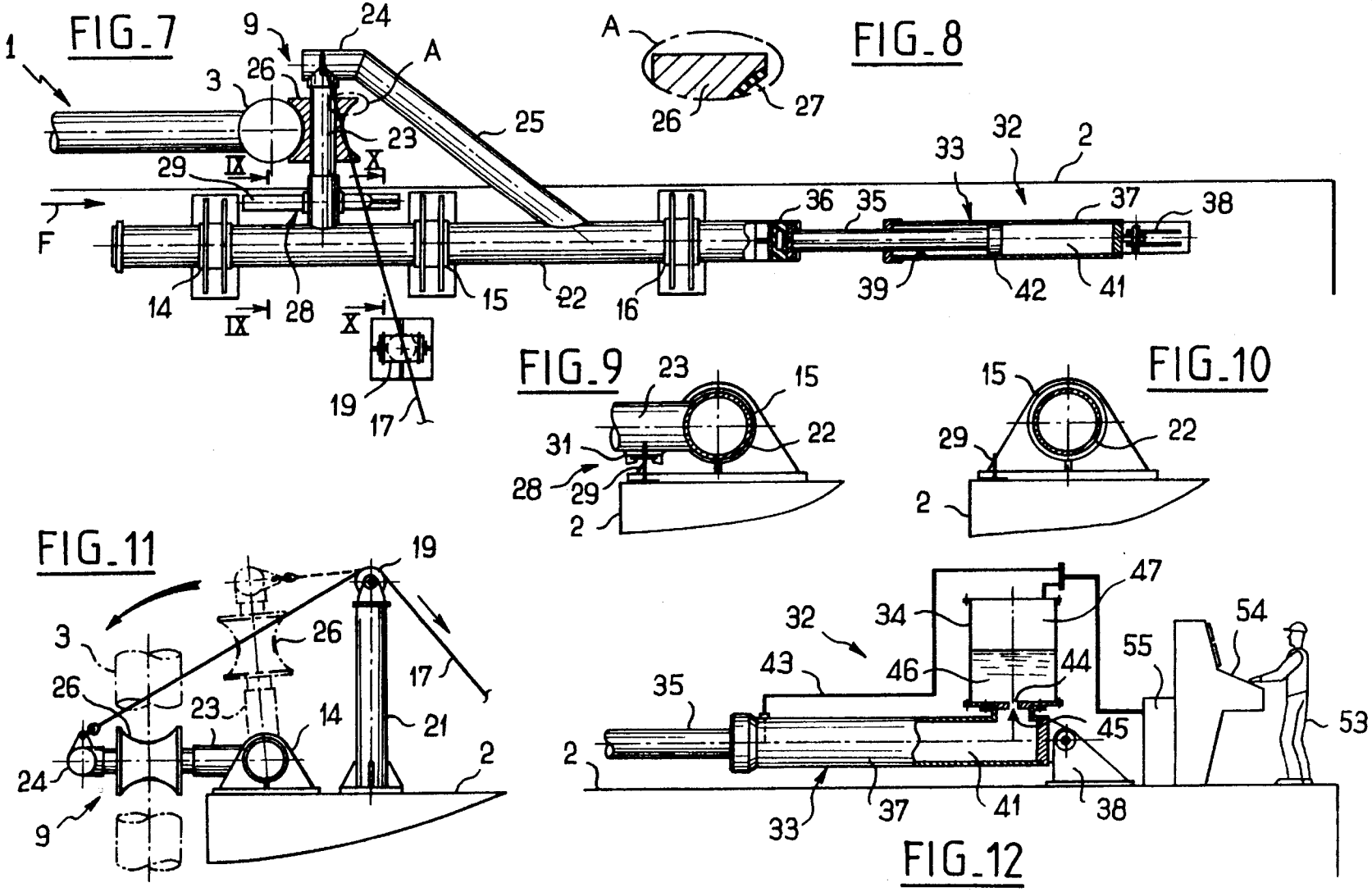
FIG. 7 is a plan view on a larger scale showing one of the bumpers of the apparatus of the present invention.
FIG. 8 shows a detail A of FIG. 7 on a larger scale.
FIGS. 9 and 10 are section views on lines IX—IX and X—X of FIG. 7 showing other details of that figure on a larger scale.
FIG. 11 is a view along arrow F of FIG. 7.
FIG. 12 is a view partly in side elevation and partly in section showing a hydraulic control system as associated with each of the bumpers of the apparatus of the invention.

Each of the four bumpers 9–12 is capable of rotating in bearings, e.g. three bearings 14, 15, and 16 aligned in a direction parallel to the longitudinal axis of the barge, as shown in FIGS. 7 and 11 for the bumper 9, the other bumpers being mounted in a manner similar to that shown in those figures. Thus, each of the four bumpers 9–12 is movable between a retracted position for transport purposes where it is substantially vertical (FIGS. 3 and 4) and a horizontal working position (FIGS. 5, 6, 7, and 11) in which the bumpers project laterally outwards from the sides of the barge 2. In their working position, the fore bumpers 9 and 10 face the front sides of the foremost legs 3 of the support structure 1 that face towards the bow of the barge 2, while the aft bumpers 11 and 12 face the aft sides of the aftermost legs 3 of the support structure 1 which face towards the stern of the barge.

Each of the four bumpers 9–12 is connected by a cable 17 to a winch 18 (FIGS. 3 to 6) which, when actuated, serves to move the corresponding bumper from its retracted transport position to its extended working position, or vice versa. Each cable 17 passes around a sheave 19 mounted at the top of a post 21 which is fixed to the deck of the barge 2 (FIG. 11) between the winch 18 and the corresponding bumper.

As shown in FIG. 7 which relates to bumper 9, each of the bumpers may be constituted by a tubular structure comprising a tube 22 which is mounted so as to be able simultaneously to slide and to rotate in the bearings 14, 15, and 16, a tube 23 having one end rigidly fixed to the tube 22 and extending perpendicularly thereto, a short tube 24 which is fixed to the other end of the tube 23 and which extends parallel to the tube 22, and a tube 25 whose ends are rigidly fixed to the tubes 22 and 24 and which extends obliquely relative thereto. The four tubes 22–25 form a structure that is approximately triangular, the tube 25 constituting a strut that enables the tube 23 to withstand the horizontal forces to which it is subjected in operation. The tube 23 carries a roller 26 capable both of rotating about the axis of the tube 23 and also of sliding along the tube 23. The peripheral surface of the roller 26 has a groove whose outline matches that of the outside surface of the leg 3 of the support structure 1. The body of the roller 26 may be made of metal, for example, and its groove is preferably lined with a flexible lining 27 (FIG. 8) enabling good contact to be established between the roller 26 and the leg 3 of the support structure 1. The lining 27 may be made of polyurethane, for example.

Each bumper is associated with a slideway system 28 (FIGS. 7 and 9) which makes it possible to hold the corresponding bumper, e.g. the bumper 9, in its horizontal working position while it is being subjected to vertical forces in operation. As shown in FIGS. 7 and 9, the slideway system 28 may be constituted by an I section metal bar 29 of the IPN girder type, which is fixed to the deck of the barge 2 so as to extend parallel to the longitudinal axis thereof, and by a C-shaped section element 31 which is rigidly fixed to the tube 23, e.g. by welding. In FIG. 9, the element 31 is shown engaged with the top horizontal flange of the bar 29. Under such conditions, the tube 23 is supported by the bar 29 and can slide along it, but it is held down in its horizontal position and the bumper 9 cannot be raised. As shown in FIG. 7 (see also FIG. 10) a portion of the top horizontal flange of the bar 29 is missing in a region close to the righthand end of the bar 29 so that the elements 29 and 31 of the slideway system 28 can be brought into engagement with each other by rotating the bumper 9 about the axis of the bearings 14–16 and then by moving it in translation parallel to said axis, or enabling the elements 29 and 31 of the slideway system 28 to be disengaged from each other, if so desired, by moving the bumper 9 in translation to the right (as seen in FIG. 7) and then by moving it in rotation in an upwards direction about the axis of the bearings 14–16.

Each of the four bumpers 9–12 is associated with a control system 32 that enables the corresponding bumper to be moved parallel to the longitudinal axis of the barge 2 so as to bring said bumper into contact with the corresponding leg 3 of the support structure 1 so as to press said bumper resiliently against said leg and then so as to lock the bumper relative to the barge 2 in application of a process that is described in detail below. The control systems 32 may be made in various different ways. For example, the systems may be purely mechanical or they may be electromechanical using linear actuators, springs, and ratchet-controlled mechanisms. Nevertheless, each control system 32 is preferably constituted by a hydraulic control system as described below.

The four hydraulic control systems 32 are identical, so consequently only one of those systems is described, e.g. the system which is associated with the bumper 9.

As shown in FIGS. 7 and 12 (see also FIGS. 22 and 23) the hydraulic control system 32 essentially comprises a double-acting hydraulic actuator 33 and a low pressure accumulator 34 connected to the actuator 33. The actuator is disposed in such a manner as to extend parallel to the longitudinal axis of the barge 2. The piston rod 35 of the actuator 33 is coaxial with the tube 22 of the bumper 9 and it is connected to one of the ends thereof by means of a semi-rigid link 36 (more clearly visible in FIG. 22). The link 36 has a certain amount of resilience in the longitudinal direction so as to be capable of being compressed elastically to a small extent, e.g. over a few centimeters, for reasons that appear below. The end of the cylinder 37 of the actuator 33 furthest from the tube 22 is connected to the deck of the barge 2 via a hinged fork 38.

Figures 22, 23, 24, 25, 26:
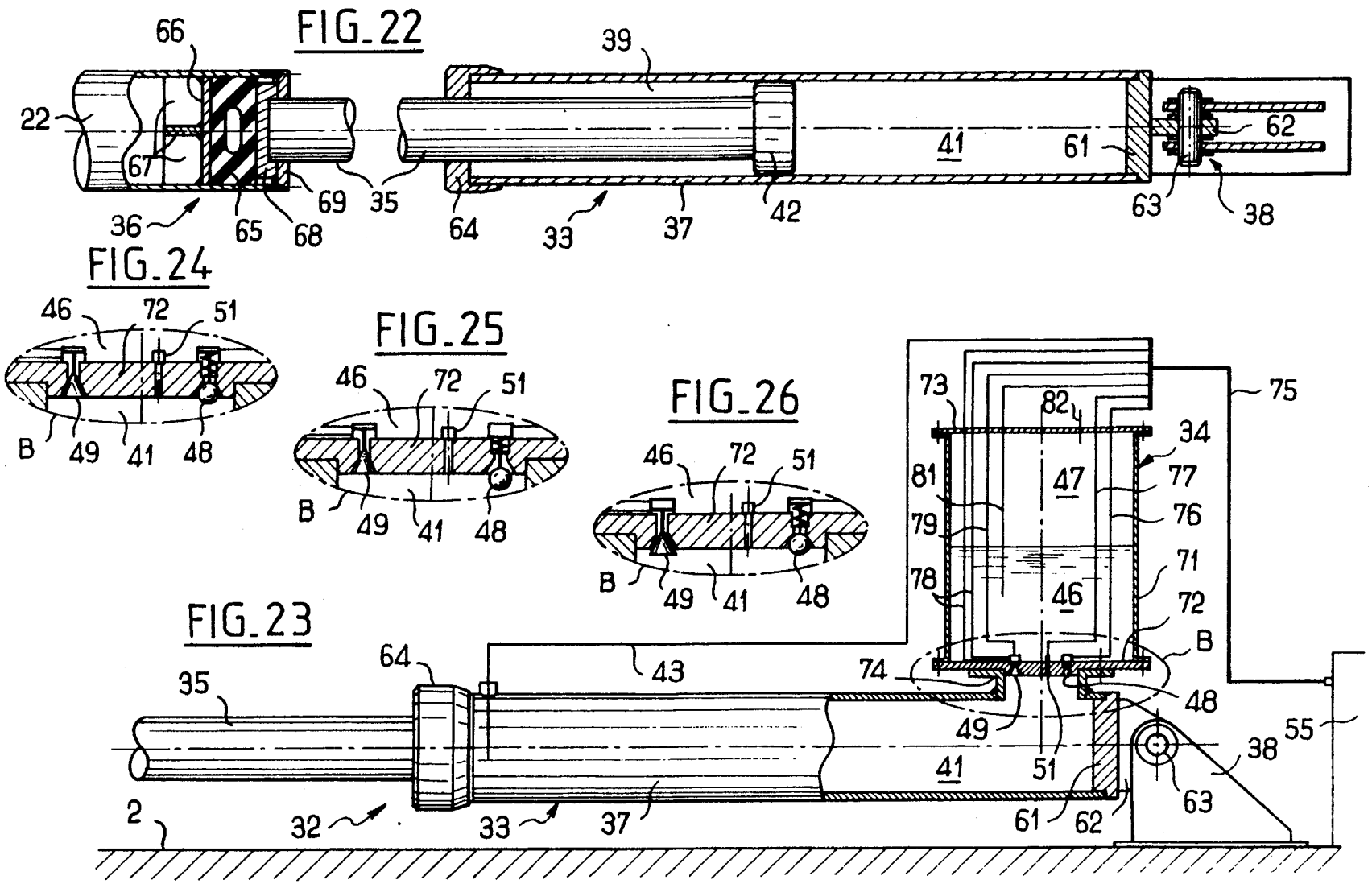
FIG. 22 is a longitudinal section on a larger scale showing the connection between the bumper of FIG. 7 and a hydraulic actuator forming a portion of the hydraulic system for controlling the bumper, together with the connection between said hydraulic actuator and the barge.
FIG. 23 is a view partly in side elevation and partly in section showing the hydraulic actuator of FIG. 22 together with a low pressure accumulator that is associated with said hydraulic actuator.
FIGS. 24, 25, and 26 show detail B of FIG. 23 on a larger scale and in three different states corresponding to the three operating stages of the apparatus of the present invention.

Two chambers 39 and 41 are formed inside the cylinder 37 of the actuator 33 on respective opposite sides of its piston 42 (FIGS. 7 and 22). The annular chamber 39 around the piston rod 35 may be fed with oil under pressure by means of a pipe 43 (FIG. 12).

The chamber 41 of the actuator 33 adjacent to the fork 38 can be put into communication with the low pressure accumulator 34 via a plurality of closable orifices (FIGS. 12, 23, and 24–26), whose nature and function are described in detail below. In FIG. 12, these closable orifices are represented symbolically and overall by a single hole 44 and by a single needle valve 45.

The low pressure accumulator 34 is preferably situated directly above the cylinder 37 of the actuator 33 at its end adjacent to the fork 38, and it contains a certain volume of oil 46 together with a gas or gaseous mixture 47 at low pressure, of the order of a few bars. The gas tends to expel the oil 46 into the chamber 41 of the actuator 33 and thus to urge the piston 42 and its rod 35 out from the cylinder 37, thereby pushing the bumper 9 towards the corresponding leg 3 of the support structure. The quantity of oil 46 contained in the low pressure accumulator 34 is greater than the volume of oil required to allow the piston 42 to perform its maximum stroke within the cylinder 37. The pressure of the gas 47 in the low pressure accumulator 34 must be sufficient to overcome friction forces in the actuator 33 and the bearings 14–16.

When the chamber 39 of the actuator 33 is fed via the pipe 43 with oil at a pressure that is greater than that which exists in the chamber 41 and in the low pressure accumulator 34, the piston 42 of the actuator 33 is moved to the right (as seen in FIG. 7), thereby causing the piston rod 35 to be retracted into the cylinder 37 of the actuator and thus placing the fore port bumper 9 in an extreme forward position relative to the barge 2. The same applies to the fore starboard bumper 10. In contrast, when oil is fed to the chambers 39 of the actuators 33 associated with the two aft bumpers 11 and 12, then they are moved into respective extreme aft positions relative to the barge 2. In other words, when the chambers 39 of all the actuators 33 are fed with oil at a pressure greater than the pressure in the chambers 41 of the actuators, then the two fore bumpers 9 and 10 are moved as far as possible away from the two aft bumpers 11 and 12, respectively. The spacing between the bumpers is thus greater than the distance between the endmost legs 3 both on the port side and on the starboard side. Under such conditions, the barge 2 is still free to perform surge motion (nevertheless limited by the anchor lines 7 and 8), without the bumpers 9–12 being able to come into contact with the legs 3 of the support structure 1 when they are in their working positions (FIG. 6).

Each of the closable orifices, as represented symbolically at 44 in FIG. 12, is in fact constituted by a plurality of controlled non-return valves 48, by two valves 48, and at least one controlled on/off valve 49 (to simplify the drawing, only one controlled non-return valve 48 and only one controlled on/off valve 49 are shown in FIGS. 22 to 26). A pressure sensor 51 serves to measure the pressure of oil in the chamber 41 of the actuator 33.

When the non-return valves 48 receive a control signal causing them to open, they establish large flow rate two-directional communication between the inside cavity of the low pressure accumulator 34 and the chamber 41 of the actuator 33 (FIG. 25). In the absence of any control signal, the non-return valves 48 establish large flow rate communication in one direction only from the inside cavity of the accumulator 34 into the chamber 41 whenever the pressure therein becomes lower than the pressure within the accumulator 34, and they close automatically whenever the pressure inside the chamber 41 tends to become greater than that inside the accumulator 44. In addition, when opened by a control signal, the controlled on/off valve 49 establishes low flow rate communication between the chamber 41 and a hydraulic fluid tank. Although this hydraulic fluid tank is shown in FIGS. 23 to 26 as being constituted by the inside cavity of the low pressure accumulator 34, the hydraulic fluid tank is preferably constituted by a tank separate from said accumulator and located, for example, on the deck of the barge 2, as indicated diagrammatically at 52 in FIG. 27.

As described below, the controlled non-return valves 48 and the controlled on/off valve 49 enable the piston 42 and the piston rod 35 to operate in three different modes as selected by an operator 53 (FIG. 12) working on a control panel 54, or under the control of a programmable controller that replaces said operator. Hydraulic control is preferably provided for opening the controlled non-return valves 48 and the controlled on/off valve 49, but it would also be possible for them to be controlled electromagnetically. Very little power is required, only a few tens of kW, in order to switch from one mode of operation to another and to perform any operation of stopping the surge motion of the barge 2. The hydraulic power required for this purpose can come from a hydraulic energy source 55 referred to as the hydraulic power supply. A single control panel 54 and a single hydraulic power supply 55 suffice for all four hydraulic control systems 32 associated with respective ones of the four bumpers 9–12.

The actuator 33 of each hydraulic control system 32 has four working modes.

In a first mode (mode 1), the chamber 39 is fed with oil at a pressure higher than the pressure that exists inside the chamber 41 and inside the low pressure accumulator 34. This has the effect of causing the piston rod 35 of the actuator 33 to be withdrawn into the cylinder 37 and of bringing it into its fully retracted position (unless it is already there). In mode 1, the non-return valves 48 are controlled so as to be held open. In the other three working modes, oil pressure in the chamber 39 is released. This can be achieved, for example, by putting the pipe 43 into communication with the hydraulic fluid tank. Nevertheless, it is preferable in this case to maintain some pressure in the chamber 39, but a pressure that is lower than that to be found in the chamber 41, thereby ensuring that there is no danger of suction in the chamber 39 impeding the movement of the piston 42 within the cylinder 37 towards the fork 38.

In the second working mode (mode 2), the piston rod 35 is free to move out from or into the cylinder 37 of the actuator 33 depending on the direction of surge motion of the barge 2, under the effect firstly of the low pressure in the accumulator 34 and secondly of the thrust exerted by the leg 3 of the support structure 1 once contact has been established between said leg and the roller 26. This mode of operation is obtained by controlling the non-return valves 48 in such a manner as to hold them open (large flow rate two-directional communication between the accumulator 34 and the chamber 41) while keeping the controlled on/off valve 49 closed. This mode of operation corresponds to FIGS. 16, 17, 18, and 25.

In the third working mode (mode 3), the piston rod 35 is free to move out from the cylinder 37 of the actuator 33, but it can no longer move back in again. This mode of operation is obtained by causing the non-return valves 48 to act as ordinary non-return valves, allowing oil to penetrate into the chamber 41 from the accumulator 34, but preventing oil leaving the chamber 41 to go back into the accumulator 34 (high flow rate communication in one direction only from the accumulator 34 towards the chamber 41), while simultaneously keeping the controlled on/off valve 49 closed. This mode of operation corresponds to FIGS. 19 to 21, and 24.

In the fourth working mode (mode 4), the piston rod 35 is subjected to a force tending to urge it back into the cylinder 37 of the actuator 33. Slow and controlled return of the piston rod 35 is made possible by controlling the on/off valve 49 in such a manner as to hold it open. A constriction 56 (FIG. 27) is associated with the on/off valve 49 and acts as a flow rate limiter so as to slow down return of the rod 35 into the cylinder 37. Clearly, if the on/off valve 49 is again put into its closed position while the piston rod 35 is moving into the cylinder, then the inwards motion of the rod 35 stops immediately since it is locked in place by the oil contained in the chamber 41 which can no longer escape via the non-return valves 48 or via the on/off valve 49.

There follows a description of how the barge 2 can be prevented from moving with surge motion relative to the support structure 1. This operation takes place in a plurality of stages.

Figure 3:
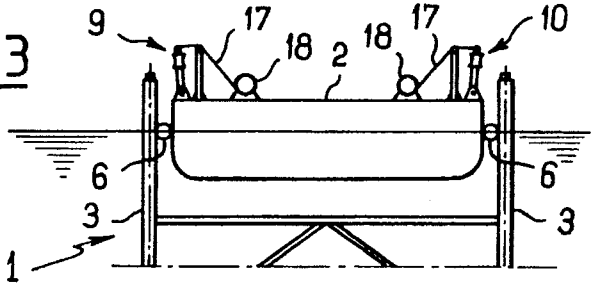
FIGS. 3 and 4 are an end view and a plan view showing the top portion of the support structure and the barge with four bumpers forming portions of the apparatus of the present invention, the four bumpers being shown in their retracted positions.
Figure 4:
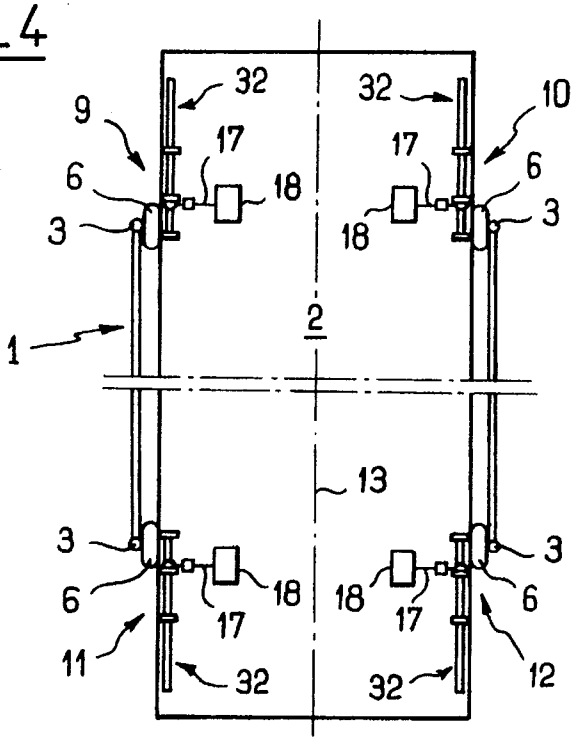

Stage 1: beginning of operation—period of observation (FIGS. 3 and 4)

During this stage, the barge 2 is in position between the legs 3 of the support structure 1. It is held by temporary means such as the anchor lines 7 and 8 and/or by tugs (not shown), or indeed by a dynamic positioning system (also not shown), all of which means are well known and do not form part of the present invention. Using such temporary holding means, the mean longitudinal position of the barge 2 between the two extreme longitudinal positions it takes up because of its alternating surge motion is caused to come close to the ideal position for holding the barge stationary.

During this stage, the bumpers 9–12 are in their retracted and substantially vertical transport position, and their actuators 33 are operating in mode 1 such that their respective piston rods 35 are fully retracted.

The total amplitude of the surging motion of the barge 2 is measured, i.e. the total fore and aft stroke of the barge due to its alternating surge motion is measured. This amplitude or total stroke must be and must remain less than the maximum acceptable stroke for the bumpers 9–12 (where the maximum acceptable stroke is determined in the particular embodiment described above by the distance between pairs of successive bearings 14 and 15 or 15 and 16, and/or by the length of the actuator 33; it is therefore determined by construction and can be selected to be as large as is desired). This is a necessary condition in order to be able to extend the bumpers 9–12 into their horizontal working positions. Conventional prior calculation serves to determine the maximum swell conditions under which this operation can be performed. In addition, the barge 2 will not be moved into position between the legs 3 of the support structure 1 unless such conditions are satisfied.

Furthermore, in order to operate under conditions that are even more favorable, it is possible to wait a few minutes for a small amplitude train in the swell prior to performing the operation. It is known that swell comes in successive trains of larger or smaller amplitude. These trains of swell can be detected in advance by known swell-measurement buoys that are put into position upstream from the support structure 1 in the swell displacement direction. For example, with the present invention, it is possible to envisage stopping surge motion of the barge even if the total amplitude of its surge motion reaches or exceeds two meters.

The relative position of the barge 2 and of the support structure 1 can be measured by a system of visual markers or by any other known measurement system and does not form part of the invention.

At this moment the operation can still be reversed. The means used for bringing the barge into position between the legs of the support structure can also be used for taking it away again.

Stage 2: extending the bumpers (FIGS. 5, 6, 11, 13, 14, and 15)

Once the decision to go ahead has been taken and the barge 2 has been properly positioned on a temporary basis between the legs 3 of the support structure 1, then the bumpers 9–12 are extended or tilted over so as to take up their horizontal working positions, i.e. so that they occupy a plane parallel to the plane of the deck of the barge 2. To this end, for each bumper, use is made of the corresponding winch 18 and cable 17 that passes over the sheave 19 at the top of the post 21. In this case, the winch 18 serves solely as a brake, given that the bumper is capable of being lowered under the effect of its own weight. In contrast, the winch 18 is used as a driving member whenever it is necessary to raise the bumper.

During this stage, the actuators 33 continue to operate in mode 1, i.e. their piston rods 35 are fully retracted. Each bumper is preferably tilted out into its horizontal position while it is in its extreme outermost position relative to the support structure 1, i.e. the fore bumpers 9 and 10 are tilted out when the barge 2 reaches or is at the end of its forward stroke, while the aft bumpers 11 and 12 are tilted out when the barge 2 reaches or is at the end of its rearward stroke.

Figure 13:
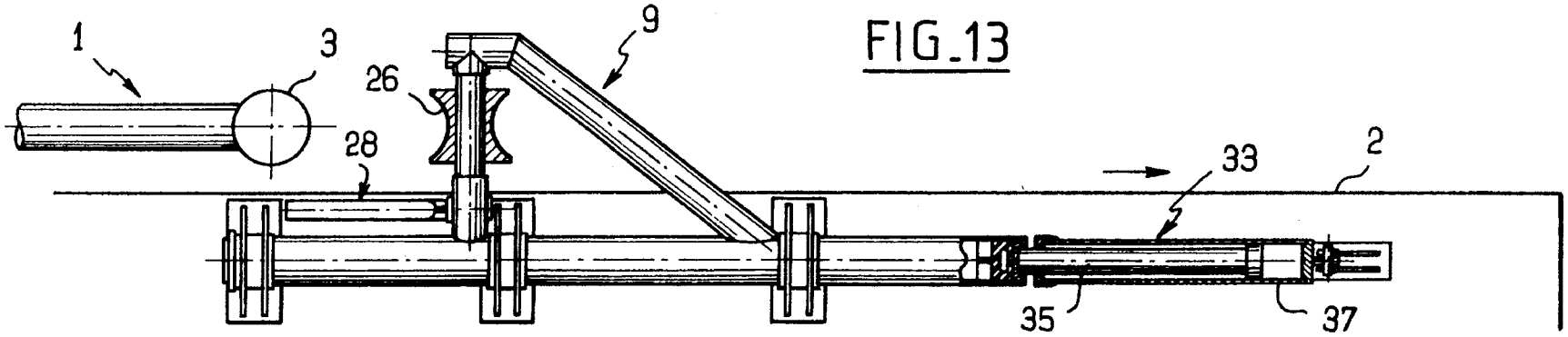
FIGS. 13, 14, and 15 are views corresponding to FIGS. 7 and 12 and show one stage in the operation of the apparatus of the invention.
Figure 14:
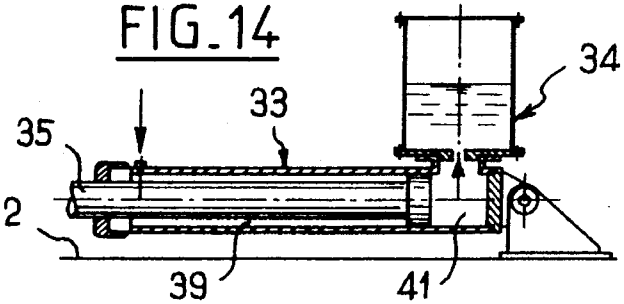
Figure 15:
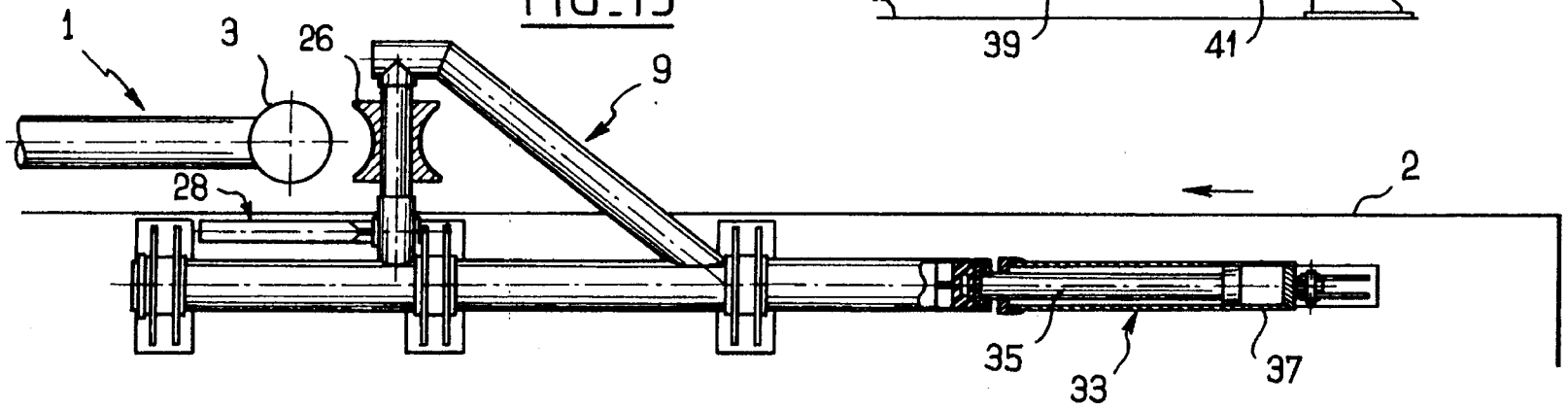

Once tilted out into its horizontal position, each bumper 9–12 rests on that end of the bar 29 of the slideway 28 which does not have a top horizontal flange (FIGS. 10, 13, and 15).

As this stage, the operation is still reversible, it is possible for each bumper to be tilted back up into its vertical position using the cable 17 and the associated winch 18.

Figure 16:
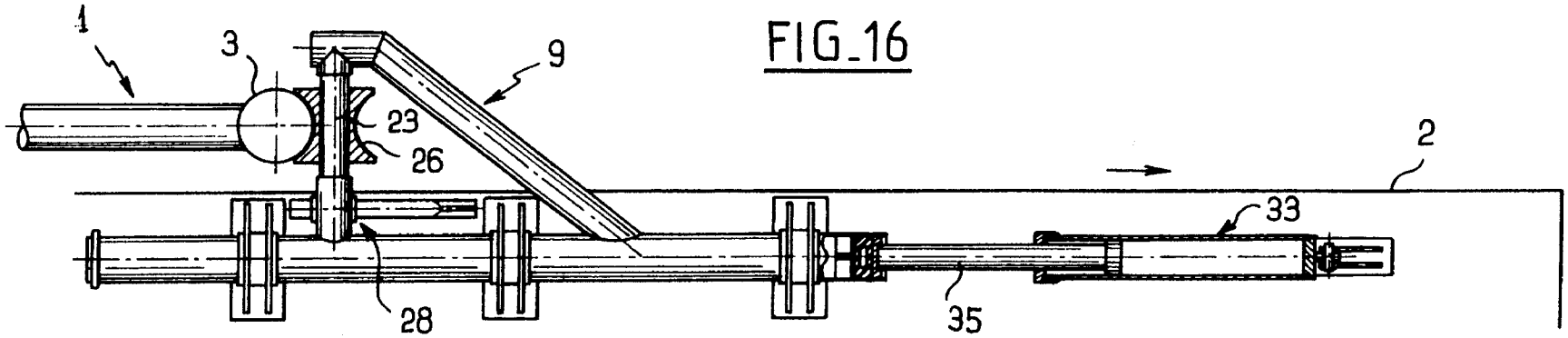
FIGS. 16, 17, and 18 are views corresponding respectively to FIGS. 13, 14, and 15 and show another stage in the operation of the apparatus of the present invent ion.
Figure 17:
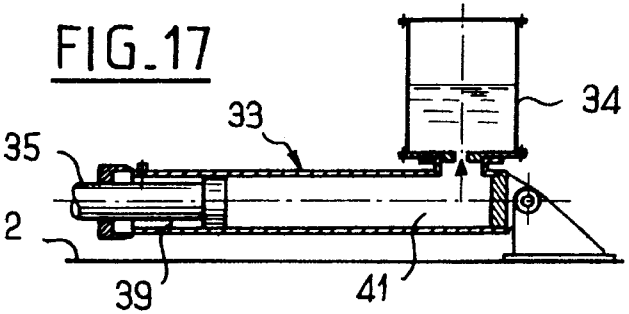
Figure 18:
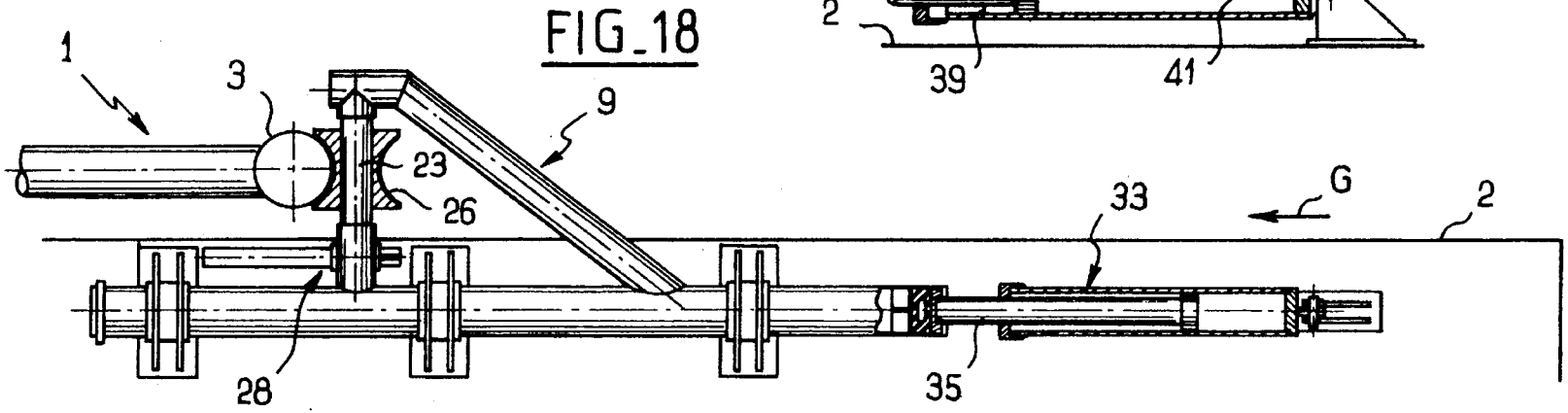

Stage 3: putting the bumpers into contact with the legs of the support structure (FIGS. 16, 17, and 18)

Once all four bumpers 9–12 have been tilted out into the horizontal position, the person in charge of the operation causes the piston rods 35 to be extended from the actuators 33 by releasing the pressure in the chamber 39 in each actuator cylinder and by causing the actuators to operate in mode 2.

Because the pressure in each chamber 39 of the actuators 33 is now lower than the pressure that exists in the accumulator 34 and the chamber 31, the piston rod 35 of each actuator 33 is extended and pushes the corresponding bumper towards the facing leg 3 of the support structure 1 until the roller 26 of the bumper comes into contact with said leg 3. Because of their Geometrical shape and because they are able to move along the axis of the corresponding tubes 23, the rollers 26 automatically take up the proper position against the corresponding legs 3 of the support structure 1. Because the bumpers exert only a small amount of force against the legs 3 of the support structure 1, the barge 2 continues to surge as before.

It should be observed that a high flow rate of oil is necessary between the low pressure accumulator 34 and the chamber 41 of the corresponding actuator 33. The rollers 26 must no longer lose contact with the legs 3 of the support structure 1 since otherwise the entire operation would be compromised because of the shocks to which that would Give rise. This high flow of several tens of liters per second is provided by the non-return valves 48 which are provided in sufficient number and/or flow section when open to enable such a flow to take place.

As mentioned above, in mode 2, the chamber 39 of each actuator 33 is still maintained under low oil pressure, lower than that in the accumulator 34, so as to avoid suction in the chamber 39 being capable of impeding retraction of the rod 35 into the cylinder of the actuator 33 when, for example and with reference to the bumper 9, the barge moves in the direction of arrow G in FIG. 18.

There is no specially favorable moment for starting to extend the piston rods 35 from the actuators 33. Nevertheless it is desirable for this to be done when ready to move on to the following stage, i.e. to stage 4 when the barge is stopped from surging, as described below.

During stage 3, the other five motions of the barge 2 cause the rollers 26 either to rotate so that they roll along the legs 3 of the support structure 1 as occurs during heave, roll, and pitching movements, or else to slide along the corresponding tubes 23 as occurs during sway and yaw movements. The top and bottom excursion limits of the rollers 26 are observed initially to ensure that there are no obstacles along the legs 3 of the support structure 1 and that the legs are tall enough. Similarly, the allowable sliding stroke for the rollers 26 on the corresponding tubes 23 must be compatible with the previously observed amplitude of the sway motion of the barge 2.

At this stage, the operation is still reversible, it being possible for the chambers 39 of the actuators 33 to be put back under pressure so as to retract the piston rods 35 and the bumpers to which they are respectively attached. The pump enabling the chambers 39 to be put back under pressure is preferably chosen in such a manner as to be capable of providing a flow rate sufficient to ensure that the bumpers can be retracted at a speed that is greater than the surge speed of the barge 2.

Figure 19:
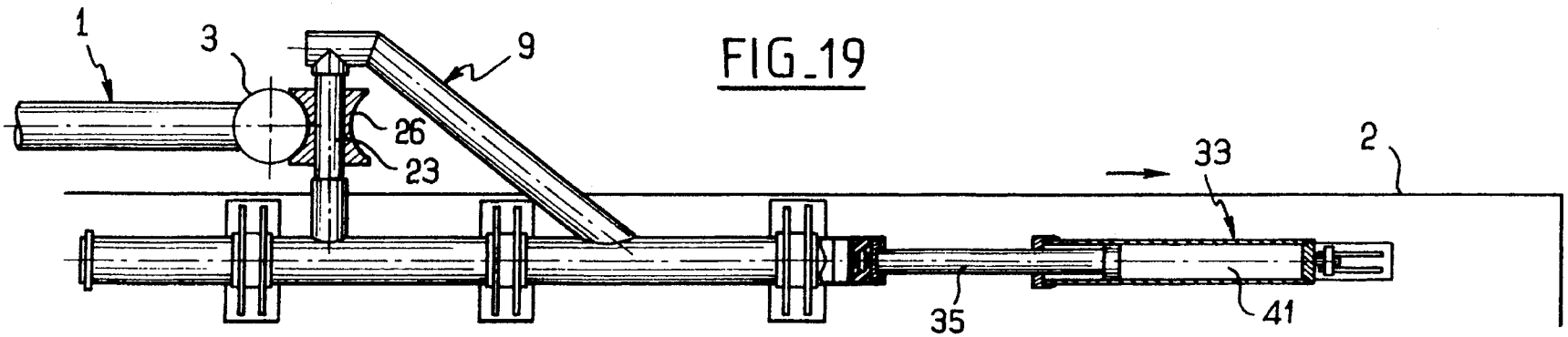
FIGS. 19, 20, and 21 are views corresponding respectively to FIGS. 13, 14, and 15, and show yet another stage in the operation of the apparatus of the present invention.
Figure 20:
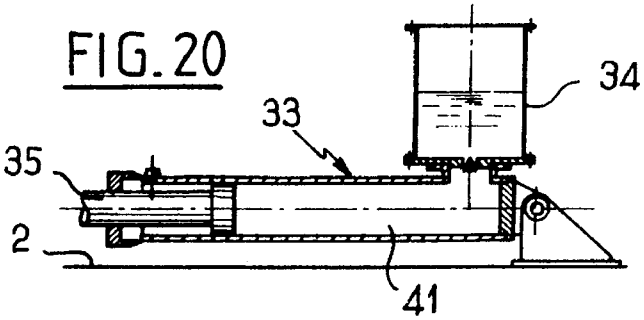
Figure 21:
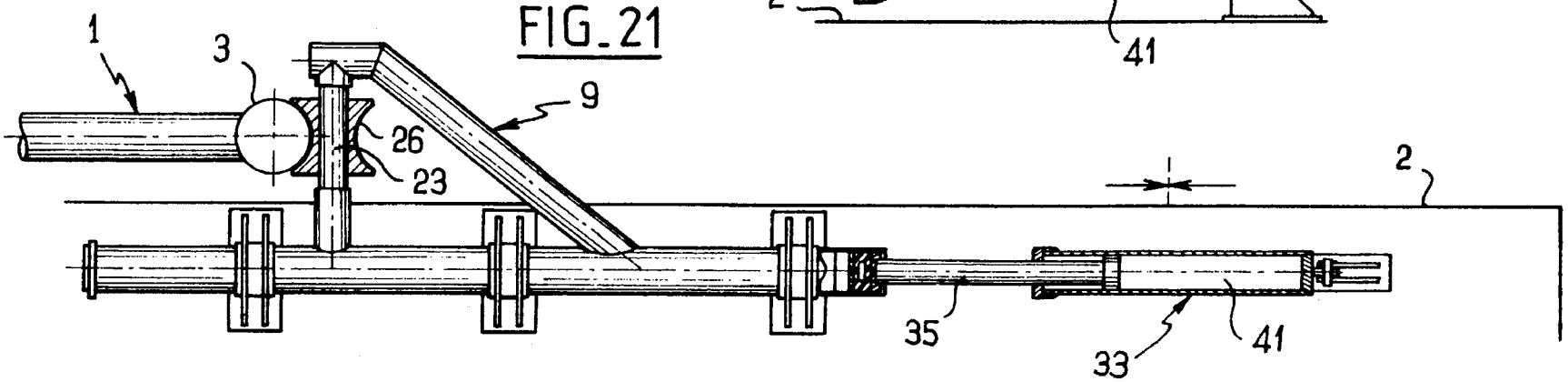

Stage 4: preventing surge motion of the barge (FIGS. 19, 20, and 21)

During the preceding stage, the rollers 26 of the bumpers 9–12 are brought into contact with the corresponding legs 3 of the support structure 1 and they are then kept pressed resiliently against said legs 3 by the low pressure that exists in the accumulators 34 and the chambers 41 of the actuators 33, however the barge 2 continues to surge and it is this surging motion that is now to be stopped. For this purpose, the barge 2 is initially brought into abutment against either its fore bumpers 9 and 10, or else its aft bumpers 11 and 12. This choice is arbitrary but it must be defined in advance. With reference to FIG. 19, which shows the fore port bumper 9, there follows a description of how the barge 2 is stopped by initially bringing the barge into abutment against the fore bumpers and then bringing the barge into abutment against the aft bumpers, with this being done in less than one half cycle of the alternating surge motion.

The barge 2 is put into abutment against the fore bumpers 9 and 10 by causing the actuators 33 associated with those bumpers to switch from mode 2 to mode 3, by removing the control signal from the non-return valves 48. The changeover from mode 2 to mode 3 is not performed at just any instant. It is performed while oil is penetrating into the chamber 41 of the cylinder of actuator 33, i.e. while the barge 2 is moving forwards, with the non-return valves 48 being closed gently when the oil flow direction reverses, i.e. when the barge begins to move backwards. If the changeover from mode 2 to mode 3 is performed while the oil is moving out from the chamber 41 into the accumulator 34, then the non-return valves 48 will close immediately and suddenly. In addition to such sudden closure being very bad for the valves themselves, the barge 2 would be stopped prematurely giving rise to dynamic effects and thus to forces that are very large on the fore bumpers 9 and 10 and on the associated actuators 33, which forces would also be applied to the support structure 1.

Preferably, in order to remove the control signal from the non-return valves 48, the operator or the controller also takes account of the reaction time of the non-return valves which is of the order of several tenths of a second.

Under such conditions, for the fore bumpers 9 and 10, the changeover from mode 2 to mode 3 logically takes place when the barge 2 at the end of its backwards stroke begins to move forwards again. At this moment, oil begins to move back out from the accumulators 34 and into the chambers 41 of the actuators 33 associated with the fore bumpers 9 and 10. The non-return valves 48 therefore remain open throughout the forward stroke of the barge 2, i.e. for several seconds. This length of time provides a comfortable safety margin for ensuring that removal of the control signal from the non-return valves 48 of the actuators 33 associated with the fore bumpers 9 and 10 takes place normally. When the oil flow direction reverses, i.e. at the exact moment when the barge seeks to begin moving backwards, the non-return valves 48 of the actuators associated with the fore bumpers close gently. The oil contained in the chamber 41 of the actuator 33 associated with each fore bumper 9 or 10 can no longer escape from said chamber 41 into the accumulator 34 and is therefore subjected to a compression force which grows in proportion to the force exerted on the barge 2 by the swell tending to cause the barge to move backwards. Since oil is incompressible, the fore bumpers 9 and 10 are locked relative to the barge 2 by the oil held captive in the chamber 41 of each of the fore actuators 33. The barge 2 is thus prevented from moving backwards.

It may be observed that the barge 2 was brought to rest at an instant when its surge speed was zero (at the moment when the direction of surge motion reverses). Consequently, the barge is brought to rest without shock or dynamic force that would otherwise have been induced by the mass of the barge 2 and its load, had the barge been in motion. This prevents any need to damp the kinetic energy of the barge and its load in motion. After the barge 2 has been brought to rest, the only force that starts to be applied progressively from a zero value against the fore bumpers 9 and 10 and against the support structure 1 is the longitudinal component of the forces applied by the swell to the barge 2. At its maximum, this component can reach a value of several hundreds of tons. Naturally, the bumpers 9–12 and the associated actuators 33 must be dimensioned accordingly.

While the barge 2 is being brought into abutment against its fore bumpers 9 and 10, the actuators 33 associated with the aft bumpers 11 and 12 continue to operate in mode 2. Once the barge 2 has been brought into abutment again its fore bumpers 9 and 10, it becomes necessary to cause the aft actuators 33, i.e. the actuators associated with the aft bumpers 11 and 12, to operate in mode 3 so that the aft bumpers can likewise act as abutment in the opposite direction. This must be done in the same half cycle of the alternating motion of the swell as that in which the barge 2 was brought into abutment against its fore bumpers 9 and 10. Otherwise, the barge 2 would be moved forwards by the swell beyond its fore locking point and perhaps beyond the zone in which its bumpers are capable of operating normally.

To this end, the control applied to the non-return valves 48 associated with the aft actuators 33 is deactivated as soon as significant pressure appears in the chambers 41 of the fore actuators 33. This means that the non-return valves 48 associated with the fore actuators 33 have just closed in order to lock the barge 2 against the fore bumpers 9 and 10. This can be detected by means of pressure sensors 51 associated with the fore actuators 33.

So long as the barge 2 is in abutment against the fore bumpers 9 and 10, i.e. so long as the swell is urging the barge 2 backwards, no oil flows through the non-return valves 48 associated with the aft actuators 33. However, as soon as the surge motion seeks to reverse, the non-return valves 48 associated with the aft actuators 33 close under the same gentle conditions as applied during closure of the non-return valves associated with the fore actuators. From this moment onwards, the oil contained in the chambers 41 of the aft actuators 33 is held captive in said chambers and can no longer escape therefrom, so the barge 2 is now held in place against both directions of surge motion.

The effects produced by the pitching and yaw motion of the barge are now examined. There is no special apparatus for limiting pitching of the barge, so the bumpers 9–12 must accommodate it. Assume that the barge 2 was brought to rest while it was horizontal. If the maximum deflection of the barge 2 due to pitching is now considered, it can be seen that the distance between the points of contact of the fore and aft bumpers against the corresponding legs 3 of the support structure 1 is greater than the same distance when the barge 2 is in the horizontal position. The increase in value of this distance can be of the order of several centimeters. If the bumpers 9–12 were completely rigid, then the distance could not increase so the bumpers 9–12 and the legs 3 of the support structure 1 would then be subjected to forces that could reach high values.

Yaw motion of the barge 2 produces a similar phenomenon. It can thus be seen that the bumpers 9–12 must have a certain amount of flexibility in compression. This flexibility is obtained firstly by the flexible lining 27 on the rollers 26 and secondly by the semi-rigid link 36 between each piston rod 35 of the actuators 33 and the corresponding tube 22 of the tubular structure constituting the bumpers 9–12.

Another semi-rigid link could also be provided at the hinged forks 38 holding the actuators 33. The extra force induced in the bumpers 9–12 and the support structure 1 by pitching and by yaw must naturally remain acceptable, i.e. within the additional stresses that the structures can accommodate. The structures should be dimensioned accordingly.

On the contrary, if the barge 2 happens to be brought to rest at a moment when its pitching is at a maximum, then when the barge returns to a horizontal position the rollers 36 of the fore and aft bumpers will tend merely to move towards one another by the piston rods 35 moving automatically out from the actuators 33 under the effect of a one-way flow of oil from each accumulator 34 into the chamber 41 of the corresponding actuator 33 which is then operating in mode 3 (the non-return valves 48 are acting as non-return valves).

At this moment, the operation is still reversible. This can be done merely by switching the actuators 33 back into mode 1, beginning by the two actuators 33 whose piston rods 35 are not in compression and terminating with the other two actuators 33 as soon as their piston rods 35 are no longer in compression.

Stage 5: fine adjustment of the relative position of the barge relative to the support structure During the preceding stage, the barge 2 has been brought to rest relative to the support structure 1. Nevertheless, the position in which the barge 2 is brought to rest does not necessarily correspond to the ideal position in which it is desirable for the barge to have been brought to rest, e.g. for the purpose of placing or removing a deck of an offshore platform. In advance, the position of the barge 2 at the moment it is brought to rest can only be estimated, and the stationary position actually obtained may be several tens of centimeters away from the ideal position or the desired position. By way of example, it is assumed that the barge 2 needs to be moved backwards in order to bring it into the desired position. Under such circumstances, each time the swell acts on the barge in a direction tending to cause it to move backwards, i.e. in a direction that corresponds to reducing the difference between the real position of the barge and its desired position, slow relative displacement between the barge 2 and the fore bumpers 9 and 10 will be allowed while the aft bumpers 11 and 12 are still capable of moving in one direction only relative to the barge 2 in order to continue to bear against the legs 3 of the support structure 1.

To this end, the procedure is to begin by waiting until the pressure in the chamber 41 of the fore actuators 33 reaches a sufficient value (which can be detected by means of the pressure sensors 51), and once the pressure has reached this value, the fore actuators 33 are caused to operate in mode 4, i.e. the on/off valves 49 of the fore actuators 33 are controlled so as to take up an open position. Under such conditions, the oil contained in the chambers 41 of the fore actuators 33 can escape slowly towards the tank 52 (FIG. 27), thereby enabling the barge 2 to move backwards slowly, with this continuing until the on/off valves 49 of the fore actuators are again controlled to take up their closed positions. During this time, the non-return valves 48 of the aft actuators 33 open automatically, allowing oil to move back into the chambers 41 of the aft actuators, so that their piston rods 35 are extended and the aft bumpers 11 and 12 are kept in contact with the corresponding legs 3 of the support structure 1. If the barge 2 still has not reached the desired position at the moment when the on/off valves 49 of the fore actuators 33 of the barge 2 are closed, then the above-described operation can be repeated during the following half cycle of the surge motion that takes place in the same direction, and this can be repeated as often as necessary in order to bring the barge 2 into the desired position.

Had it been necessary to move the barge 2 forwards in order to bring it into the desired position, then the procedure would have been similar, with the on/off valves 49 of the aft actuators 33 being opened each time the swell as tending to move the barge 2 forwards.

At this moment, the operation is still reversible, as already explained with reference to stage 4.

There now follows a description of various additional details concerning the implementation of the actuators 33, their accumulators 34, and the hydraulic circuits used to operate them.

As can be seen in FIG. 22, the cylinder of the actuator 33 comprises a tubular portion 37 that is closed in sealed manner adjacent to the fork 38 by an end wall or plug 61 that is screwed or welded to the tube 37. The end plug 61 is welded to a lug 62 which is itself connected to the fork 38 by a pin 63. The forces that hold the barge 2 stationary relative to the support structure 1 pass via said lug 62, said pin 63, and said fork 38. These components must therefore be dimensioned accordingly.

At the other end of the tube 37 of the actuator 33, an annular plug or end wall 64 allows the piston rod 35 to pass through its middle and is screwed to the tube 37. Sealing is provided by gaskets (not shown) between the piston 42 and the tube 37, between the piston rod 35 and the annular plug 64, and between said plug and the tube 37.

The semi-rigid link 36 connecting the piston rod 35 of the actuator 33 to the tube 22 of the tubular structure forming the associated bumper comprises a part 65 made of elastomer material which bears against a metal sheet 66 welded inside the tube 22 and stiffened by a plurality of gusset plates 67 themselves welded to the metal sheet 66, to the tube 22 and to one another. An endpiece or pressure plate 68 distributes pressure within the part 65 made of elastomer material, and is screwed to the end of the piston rod 35. A flange 69 bolted to the end of the tube 22 and co-operating with the pressure plate 68 enables the piston rod 35 of the actuator 33 to pull the associated bumper towards the fork 38 when the chamber 39 of the actuator is fed with oil under pressure.

The part 65 made of elastomer material is mounted between the thrust sheet 66 and the pressure plate 68 in such a manner as to be compressed not at all or very little when the bumper is at rest. In addition, the thickness and/or the elastomer material of the part 65 are chosen in such a manner that said part is compressed only very little (a few centimeters or about 10 centimeters) in comparison with the surge stroke when the bumper is in contact with a leg 3 of the support structure and is pressed thereagainst by the force of the swell acting on the barge. In addition, the part 65 made of elastomer material is designed to withstand the pinching effect due to pitching without simultaneously giving rise to additional forces that are too great within the apparatus.

With reference to FIG. 23, it can be seen that the accumulator 34 comprises a tube 71 with flanges at each end, a bottom plate 72, and a cover 73. These three elements are bolted to one another. The bottom plate 72 of the accumulator 34 is also bolted to an annular coupling flange 74 which is welded to the tube 37 that forms the cylinder of the actuator 33, located close to the end plug 61 thereof. The above-mentioned bolted connections are sealed by gaskets (not shown). The controlled non-return valve(s) 48 and the controlled on/off valve(s) 49 for putting the accumulator 34 into communication with the chamber 41 of the actuator 33 are mounted in the bottom plate 72 of the accumulator. The non-return valve 48 and the on/off valve 49 shown in FIGS. 23 to 26 (one of each being shown only) can, in practice, be provided in greater numbers for reasons of reliability or of flow section.

In FIG. 23, the set of pipes 75 connecting the hydraulic power unit 55 to the hydraulic control system 32 comprises the pipe 43 for feeding oil to the chamber 39 of the actuator 33, the pipe 76 for controlling the non-return valve 48, the pipe 77 for measuring the oil pressure in the chamber 41, two pipes 78 for controlling the on/off valve 49, the pipe 79 for removing oil under pressure from the chamber 41 through the valve 49 when open, and the pipe 81 for returning oil to the accumulator 34. The pipe 82 is used for inflating the low pressure accumulator 34 with a gas or a mixture of gases such as air or nitrogen.

It will be observed that if the pressure sensor 51 is mounted in the bottom plate 72 of the accumulator 34, then the pipe 77 contains conductors that convey the output signal from the pressure sensor to the control panel 54. Nevertheless, the pressure sensor 51 could be placed remotely from the bottom plate 72, e.g. in the cover 73 or in the hydraulic power supply 55. In which case, the pipe 77 puts the chamber 41 of the actuator 33 into communication with the pressure sensor.

Although the pipes 76–82 are shown in FIG. 23 as passing through the cover 73 of the accumulator 34, all or some of the pipes could, where convenient, pass through the wall of the tube 71. Whenever a pipe passes through the cover 73 (or the tube 71) sealing is naturally provided by appropriate gaskets (not shown).

Figure 27:
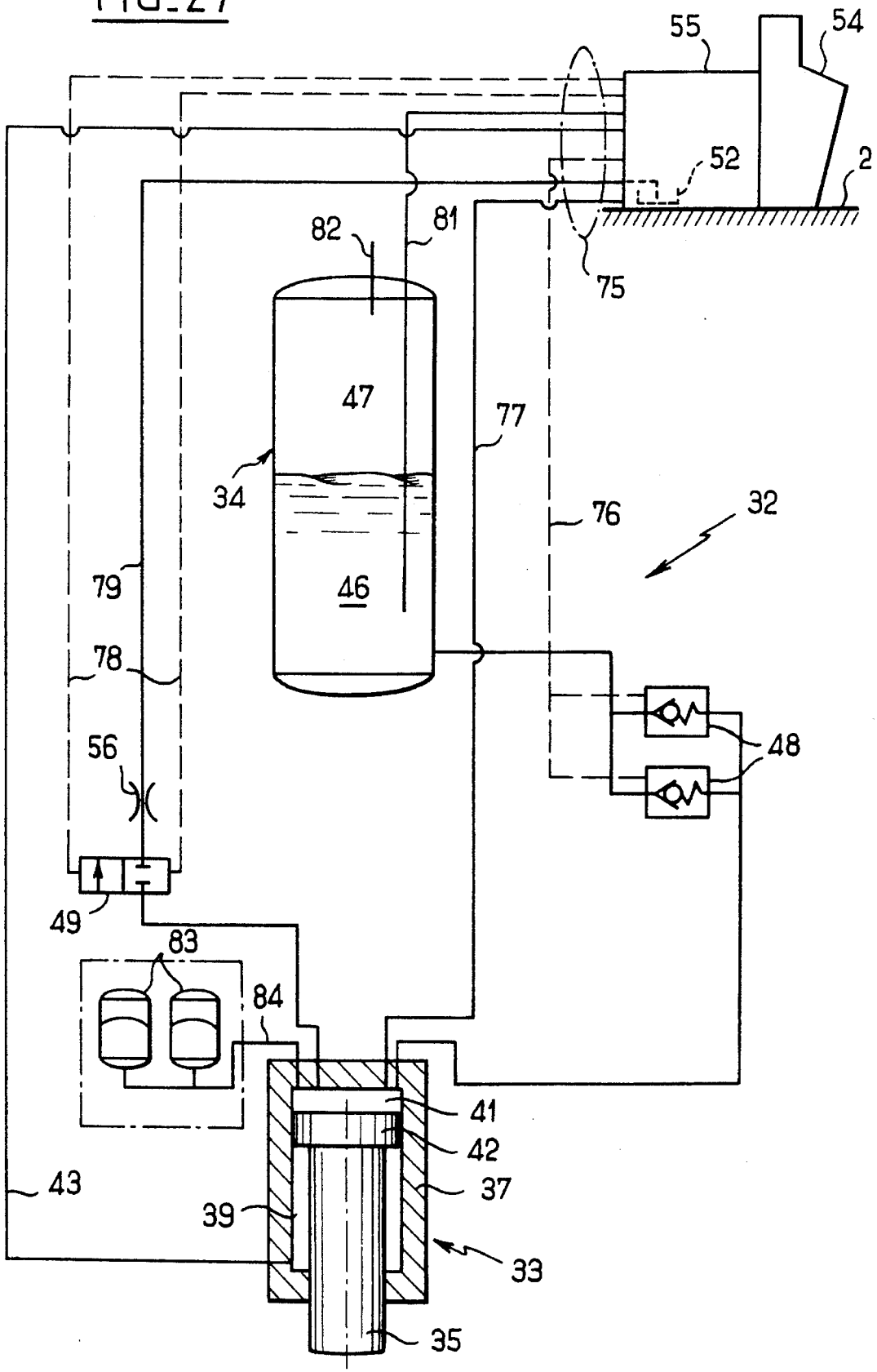
FIG. 27 is a hydraulic circuit diagram for the control system of the hydraulic actuator shown in FIGS. 22 and 23.

FIG. 27 is a hydraulic circuit diagram of the controlling hydraulic system 32 of the invention. The diagram shows elements that are described above with reference to FIGS. 12 and 23 to 26. There is therefore no need to describe those elements again. The controlled non-return valves 28 are shown as being two in number by way of indication only. The controlled on/off valve 49 is shown as being implemented in the form of a distributor valve having two ports and two positions, which valve is subjected to control from both sides by control pressure which is applied to one or other of the two pipes 78. Nevertheless, it is clear that the distributor valve 49 could be controlled by control pressure on one side only and be returned by a spring on the other side. For example, the distributor valve 49 may be held in its closed position by a spring and it may be moved into its open position by applying control pressure.

FIG. 27 also shows two high pressure accumulators 83 which are in communication via a pipe 84 with the chamber 41 of the actuator 33. The accumulators 83 can be used to attenuate the effect of an accidental impact against the bumper associated with the actuator 33. By way of example, the high pressure accumulators 83 may be installed on the bottom plate 72 of the low pressure accumulator 34. Although FIG. 27 shows two high pressure accumulators 83, the invention is naturally not limited to that particular number.

Compared with existing systems that enable the surge motion of a barge or of some other floating structure to be reduced, the apparatus of the present invention presents the following advantages, amongst others:

a) No known anti-surge apparatus is capable of bringing to rest a large barge when the total amplitude of its surge motion comes up to about 1 meter. In contrast, the apparatus of the invention can easily bring the largest barges presently in existence in the world to rest even when subject to surge motion having a total amplitude of several meters.

b) The apparatus of the invention and the support structure are never subjected to dynamic forces due to the moving masses of the barge and its load. As mentioned above, the barge and its load are brought to rest at the moment when their speed is zero. Consequently, the apparatus of the invention is subjected to much less force than is any known apparatus.

c) The operation of bringing the barge to rest is much quicker than with previously known apparatus.

d) Once the barge has been brought to rest, the apparatus of the invention also serves, if so desired, to perform fine adjustment on the position of the barge relative to the support structure. This fine adjustment can be performed with unparalleled gentleness.

e) The apparatus of the invention is simple and capable of using standard components that have already proved their worth in the industry. It is therefore highly reliable and the operation of bringing the barge to rest can be performed with great reliability.

f) The same apparatus can be used in a very large number of operations and its final cost can be less than that of known apparatuses that damp energy, a portion of which is made of expensive elastomer and is lost during each operation. On the same lines, the cost of the apparatus is not very high, given the simplicity of its components which are mostly standard.

g) Very little power is required to operate the apparatus of the invention. The apparatus therefore saves energy.

Naturally the particular embodiment of the invention described above has been given purely by way of non-limiting example, and numerous modifications can easily be provided by the person skilled in the art without thereby going beyond the ambit of the invention. Thus, in particular, instead of the fore bumpers 9 and 10 (see FIG. 6) being disposed to act on the front vertical surfaces of the foremost legs 3 of the support structure 1 and the aft bumpers 11 and 12 being disposed to act on the rear vertical surfaces of the rearmost end legs 3 of the support structure 1, the bumpers 9 and 10 could be disposed to act on the front vertical surfaces of the rearmost legs 3 and the bumpers 11 and 12 could be disposed to act on the rear vertical surfaces of the foremost legs 3, providing the support structure 1 does not include members between its foremost and rearmost legs 3 that could impede the longitudinal motions of the bumpers 9–12.

In addition, although the present invention is described above with reference to bringing a barge to rest relative to the support structure ("jacket") of an offshore platform, the apparatus of the invention can be used for bringing any floating offshore structure to rest (to within the tolerance provided by its internal elasticity) whenever said structure is subjected by swell to surge motion relative to another offshore structure that is fixed or likewise floating. For example, the apparatus of the invention may be used to prevent relative surging motion between two ships that are located side by side or between a ship and an adjacent Jetty. In those cases, the apparatus of the invention could comprise two bumpers only. When a ship is to be held stationary relative to a jetty, the bumpers may be installed either on the ship or else on the jetty, with vertical thrust surfaces then being provided for the bumpers either on the jetty or on the ship, as appropriate.

I claim:

1. A method of reducing to a small value any alternating surge motion between two offshore structures which have been placed one beside the other and at least one of which is floating, a first of the two offshore structures having first and second vertical thrust surfaces facing in opposite directions along a horizontal direction in which the surge motion that is to be reduced is taking place, the second offshore structure including at least first and second bumpers capable of being displaced from respective retracted positions to respective extended positions in which the first and second bumpers face the first and second thrust surfaces respectively of the first offshore structure, the method consisting:

a) in installing the first and second bumpers on the second offshore structure in such a manner that, in their respective extended positions, they are horizontally spaced apart from said first and second thrust surfaces, and that each of said bumpers is also movable in a direction parallel to the direction of surge motion with a maximum acceptable stroke of predefined value;

b) in bringing one of the two offshore structures into a position such that its mean position between two extreme positions due to the alternating surge motion corresponds approximately to the desired position for said offshore structure relative to the other offshore structure;

c) in measuring the total amplitude of the alternating surge motion between the two extreme positions;

d) in placing the first and second bumpers into their respective extended positions if the total measured amplitude is smaller than the maximum acceptable stroke of the bumpers;

e) in bringing the first and second bumpers into contact with the first and second thrust surfaces respectively of the first offshore structure and in holding them pressed resiliently against said thrust surfaces with a predefined thrust force, while nevertheless allowing alternating relative motion to take place between each of the two bumpers and the second offshore structure in both directions of the surge motion; and f) in bringing the bumpers to rest relative to the second offshore structure at a moment when the speed of surge motion is zero.

2. A method according to claim 1, wherein for step f), relative motion is allowed in one direction only between the first bumper and the second offshore structure in the direction of the thrust force of the first bumper against the first thrust surface of the first offshore structure during a stage when the surge motion is taking place in a first direction tending to move the first bumper away from the first thrust surface, such that the horizontal movement of the first bumper relative to the second offshore structure is stopped at the moment when the direction of the surge motion reverses, thereby preventing the two offshore structures from being able to continue moving one relative to the other during the immediately following stage where the surge motion is tending to take place in a second direction opposite to the first direction, and thereafter, during said immediately following stage, relative motion is allowed in one direction only between the second bumper and the second offshore structure in the direction of the thrust force of the second bumper against the second thrust surface in such a manner that horizontal movement of the second bumper relative to the second offshore structure is stopped at the moment when the direction of surge motion is tending to reverse again, all surge motion of one of the two offshore structures relative to the other then being prevented in both directions.

3. A method according to claim 1, consisting in verifying whether the two offshore structures are in the desired position relative to each other after surge motion has been brought to rest, and if they are not in the desired position, then, each time the swell acts on the offshore structures in a direction corresponding to reducing the difference between said desired position and the current position of the two offshore structures relative to each other, authorizing slow relative displacement between the second offshore structure and that one of the two bumpers which is pushed by the action of the swell against the corresponding thrust surface of the first offshore structure, while the other bumper is authorized to move in one direction only relative to the second offshore structure and is thus kept bearing against the other thrust surface of the first offshore structure.

4. Apparatus for reducing to a small value any alternating surge motion between two offshore structures which have been placed side by side and of which at least one is floating and subjected to the effect of the swell, a first of the two offshore structures having first and second vertical thrust surfaces which face in opposite directions along a horizontal direction in which the surge motion to be reduced is taking place, the second offshore structure including at least first and second bumpers which are mounted on the second offshore structure in such a manner as to be movable between respective retracted positions and respective extended positions in which they face the first and second thrust surfaces respectively of the first offshore structure, and first and second actuator means connected to the first and second bumpers respectively to bring them into their extended positions, wherein the first and second bumpers are mounted on the second offshore structure in such a manner that, in their respective extended positions, they are horizontally spaced apart from said first and second thrust surfaces, and that each of them is also movable horizontally in a direction parallel to the direction of surge motion, said apparatus further comprising third and fourth actuator means connected to the first and second bumpers respectively to bring them into contact with the first and second thrust surfaces respectively of the first offshore structure, first and second pressure means associated with the first and second bumpers respectively to keep them resiliently pressed against said thrust surfaces while nevertheless allowing alternating relative motion between each of the two bumpers and the second offshore structure in both directions of the surge motion, and first and second controlled locking means associated with the first and second bumpers respectively to hold them stationary relative to the second offshore structure when so desired.

5. Apparatus according to claim 4, wherein each of said first and second controlled locking means is constituted by coupling means mounted between the third or fourth actuator means and the first or second pressure means respectively, and having two states, namely: a first state authorizing said alternating relative motion between the corresponding first or second bumper and the second offshore structure in both directions of surge motion; and a second state authorizing relative movement in one direction only between the corresponding first or second bumper and the second offshore structure in the direction of the thrust force of said corresponding first or second bumper against the associated thrust surface of the first offshore structure, each of the coupling means acting as locking means when in its second state.

6. Apparatus according to claim 5, wherein each of the third and fourth actuator means is constituted by a double acting hydraulic actuator which is mounted between the second offshore structure and the corresponding first or second bumper and has its longitudinal axis parallel to the direction of surge motion, and wherein each of the first and second pressure means is constituted by a low pressure accumulator connected by said coupling means to one of the chambers of the hydraulic actuator which, when fed with hydraulic fluid under pressure by the low pressure accumulator causes the corresponding bumper to be moved towards the associated thrust surface of the first offshore structure.

7. Apparatus according to claim 6, wherein said coupling means is constituted by at least one controlled non-return valve which, when put in a first state, establishes both-way communication at a high flow rate between the low pressure accumulator and said chamber of the hydraulic actuator, and when put in a second state, authorizes one-way communication only at a large flow rate from the low pressure accumulator towards said chamber of the hydraulic actuator.

8. Apparatus according to claim 7, further comprising at least one controlled on/off valve or controlled distributor valve having two ports and two positions, which valve is connected in series with a flow rate limiter and can be controlled to establish communication at a low flow rate between said chamber of the hydraulic actuator and a hydraulic fluid tank.

9. Apparatus according to claim 4, wherein each of the first and second bumpers is constituted by a tubular structure comprising a first tube mounted to be capable both of sliding and of revolving in bearings carried by the second offshore structure and aligned in the direction of surge motion, a second tube having one end rigidly secured to the first tube and extending perpendicularly thereto, and a third tube which is fixed rigidly to the first and second tubes in such a manner as to form therewith a structure that is approximately triangular, and a roller which is mounted on the second tube in such a manner as to be capable both of rotating and of sliding therealong, and which is designed to come into contact with one of the first and second thrust surfaces of the first offshore structure.

10. Apparatus according to claim 9, wherein the second offshore structure and the second tube of each bumper include mutually co-operating slideway means for the purpose of supporting, guiding, and retaining the corresponding bumper in its extended position during its horizontal movements relative to the second offshore structure.

11. Apparatus according to claim 9, wherein the first and second thrust surfaces of the first offshore structure are cylindrical, and wherein the roller includes a groove in its peripheral surface, the profile of the groove having a radius that matches the radius of the cylindrical surfaces of said thrust surfaces.

12. Apparatus according to claim 11, wherein the groove of the roller is lined with a flexible lining.

13. Apparatus according to claim 6, wherein each of the first and second bumpers is constituted by a tubular structure comprising a first tube mounted to be capable both of sliding and of revolving in bearings carried by the second offshore structure and aligned in the direction of surge motion, a second tube having one end rigidly secured to the first tube and extending perpendicularly thereto, and a third tube which is fixed rigidly to the first and second tubes in such a manner as to form therewith a structure that is approximately triangular, and a roller which is mounted on the second tube in such a manner as to be capable both of rotating and of sliding therealong, and which is designed to come into contact with one of the first and second thrust surfaces of the first offshore structure, and wherein the rod of each hydraulic actuator is coupled at one end to the first tube of the corresponding bumper via a semi-rigid link possessing some elasticity in the longitudinal direction.

14. Apparatus according to claim 4, designed to reduce surge motion between a barge and a support structure for an offshore platform, while installing an offshore platform deck that is carried by the barge on legs of the support structure, or while removing said deck, wherein said first offshore structure is the support structure for the offshore platform and said second offshore structure is the barge.

15. Apparatus according to claim 14, wherein the first and second thrust surfaces are the_vertical cylindrical surfaces of two of the legs of the support structure for the offshore platform.

16. Apparatus according to claim 14, comprising two first bumpers disposed in the forward region of the barge symmetrically about its longitudinal axis, and two second bumpers disposed in the aft region of the barge symmetrically about its longitudinal axis, and wherein each bumper is designed to co-operate with a respective leg of the support structure for the platform.

* * * * *